US009515384B2

(12) United States Patent
Kang

(10) Patent No.: US 9,515,384 B2
(45) Date of Patent: Dec. 6, 2016

(54) APPARATUS AND METHOD FOR SETTING ANTENNA RESONANT MODE OF MULTI-PORT ANTENNA STRUCTURE

(71) Applicant: MEDIATEK INC., Hsin-Chu (TW)

(72) Inventor: Ting-Wei Kang, Kaohsiung (TW)

(73) Assignee: MEDIATEK INC., Hsin-Chu (TW)

( * ) Notice: Subject to any disclaimer, the term of this patent is extended or adjusted under 35 U.S.C. 154(b) by 180 days.

(21) Appl. No.: 14/339,423

(22) Filed: Jul. 23, 2014

(65) Prior Publication Data

US 2015/0065066 A1 Mar. 5, 2015

Related U.S. Application Data

(60) Provisional application No. 61/872,939, filed on Sep. 3, 2013.

(51) Int. Cl.
*H01Q 9/42* (2006.01)
*H01Q 1/24* (2006.01)

(52) U.S. Cl.
CPC ..... *H01Q 9/42* (2013.01); *H01Q 1/243* (2013.01)

(58) Field of Classification Search
CPC ..... H01Q 1/243
See application file for complete search history.

(56) References Cited

U.S. PATENT DOCUMENTS 6,693,594 B2 2/2004 Pankinaho
2002/0180650 A1 12/2002 Pankinaho
2005/0245202 A1* 11/2005 Ranta ..... H04B 1/48 455/78
2008/0055164 A1* 3/2008 Zhang ..... H01Q 1/243 343/702
2008/0258991 A1* 10/2008 Montgomery ..... H01Q 1/243 343/844
2013/0325149 A1* 12/2013 Manssen ..... H04B 1/0458 700/37
2014/0378188 A1* 12/2014 Liu ..... H04W 52/0261 455/574

FOREIGN PATENT DOCUMENTS

CN 101730957 A 6/2010
CN 101826651 A 9/2010
CN 102881997 A 1/2013
TW 201004044 A 1/2010

* cited by examiner

*Primary Examiner* — David Bilodeau
(74) *Attorney, Agent, or Firm* — Winston Hsu; Scott Margo

(57) ABSTRACT

An antenna tuning circuit for setting an antenna resonant mode of an antenna structure includes a switch arranged to selectively couple a first interconnection node to a second interconnection node, wherein the first interconnection node is coupled to a first port of the antenna structure, and the second interconnection node is coupled to a second port of the antenna structure. An antenna tuning method for setting an antenna resonant mode of an antenna structure includes generating a first control signal and selectively coupling a first interconnection node to a second interconnection node in response to the first control signal, wherein the first interconnection node is coupled to a first port of the antenna structure, and the second interconnection node is coupled to a second port of the antenna structure.

18 Claims, 11 Drawing Sheets

(A)

(B)

APPARATUS AND METHOD FOR SETTING ANTENNA RESONANT MODE OF MULTI-PORT ANTENNA STRUCTURE

CROSS REFERENCE TO RELATED APPLICATIONS

This application claims the benefit of U.S. provisional application No. 61/872,939, filed on Sep. 3, 2013 and incorporated herein by reference.

BACKGROUND

The disclosed embodiments of the present invention relate to an antenna design, and more particularly, to an antenna tuning circuit for setting an antenna resonant mode of a multi-port antenna structure and a related antenna tuning method thereof.

The growth of the usage of mobile internet and multimedia services has been explosive in recent years. With the enriched features and services available to the end users, the mobile devices, including smart phones, tablets, wearable devices, etc., are required to support higher data rates promised by 3G (third generation), 4G (fourth generation) or more advanced communication standard with backward compatibility of the legacy 2G (second generation) communication standard. In the meantime, a combination of different frequency bands will need to be supported. Consequently, the increase in complexity of the mobile devices leads to greater challenges and more stringent requirements on the front-end design and the antenna design. To achieve reduced cost and chip area, a multimode multiband (MMMB) solution is proposed for supporting multiple air interface standards while covering multiple frequency bands. However, concerning a slim mobile device with a metal housing, the design difficulty of an antenna used in the MMMB environment is raised. Thus, there is a need for an adaptive antenna solution which is capable of meeting the MMMB requirement of a slim mobile device.

SUMMARY

In accordance with exemplary embodiments of the present invention, an antenna tuning circuit for setting an antenna resonant mode of a multi-port antenna structure and a related antenna tuning method thereof are proposed to solve the above-mentioned problem.

According to a first aspect of the present invention, an exemplary antenna tuning circuit for setting an antenna resonant mode of an antenna structure is disclosed. The exemplary antenna tuning circuit includes a switch arranged to selectively couple a first interconnection node to a second interconnection node, wherein the first interconnection node is coupled to a first port of the antenna structure, and the second interconnection node is coupled to a second port of the antenna structure.

According to a second aspect of the present invention, an exemplary antenna tuning method for setting an antenna resonant mode of an antenna structure is disclosed. The exemplary antenna tuning method includes: generating a first control signal; and selectively coupling a first interconnection node to a second interconnection node in response to the first control signal, wherein the first interconnection node is coupled to a first port of the antenna structure, and the second interconnection node is coupled to a second port of the antenna structure.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

In accordance with embodiments of the present invention, an adaptive antenna solution capable of meeting the MMMB requirement of an electronic device, such as a smart phone, a tablet or a wearable device, is proposed. The adaptive antenna solution can provide high performance, and is suitable for the practical project process. For example, the adaptive antenna solution may possess good antenna tuning flexibility and/or good component reservation/removal flexibility to meet different application requirements. Since the adaptive antenna tuning circuit implemented on a printed circuit board (PCB) can be controlled to employ one of a plurality of supported antenna topologies, the same PCB can be employed by any of different products without PCB re-design, thus shortening the time to market. Further details of the proposed adaptive antenna solution are described as below.

Figure 1:
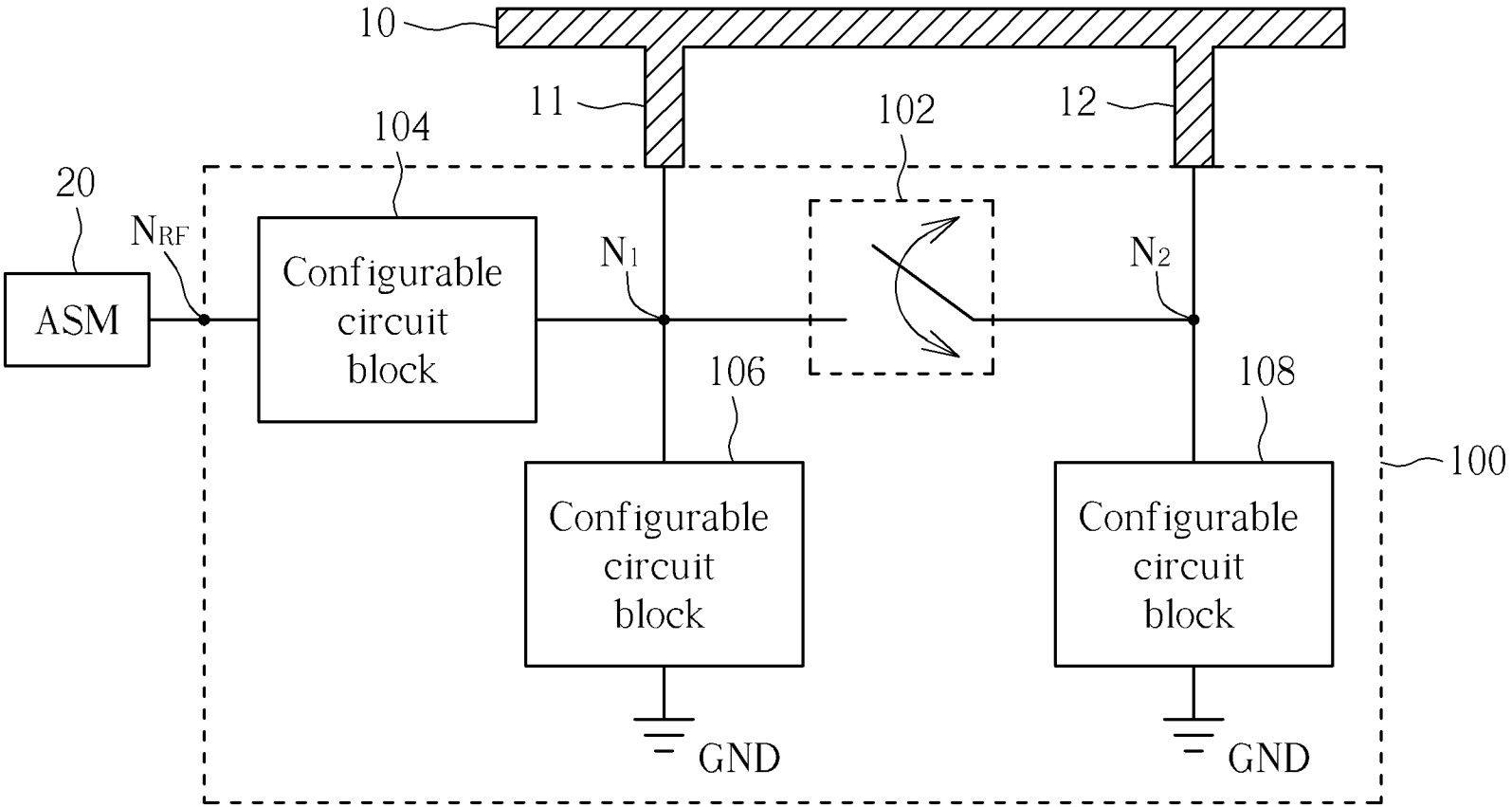
FIG. 1 is a diagram illustrating an antenna tuning circuit according to an embodiment of the present invention.

FIG. 1 is a diagram illustrating an antenna tuning circuit according to an embodiment of the present invention. The antenna tuning circuit 100 may be used for setting an antenna resonant mode of an antenna structure 10. In this embodiment, the antenna structure 10 may be a multi-port antenna structure having at least a first port 11 and a second port 12. As shown in FIG. 1, the antenna tuning circuit 100 may have a first interconnection node $N_1$ coupled to the first port 11 of the antenna structure 10, a second interconnection node $N_2$ coupled to the second port 12 of the antenna structure 10, and a radio frequency (RF) source node $N_{RF}$. In some embodiments, the RF source node $N_{RF}$ may be coupled to an antenna switch module (ASM) 20. The antenna tuning circuit 100 may include a switch 102 and at least one configurable circuit block. In this embodiment, multiple configurable circuit blocks 104, 106 and 108 are implemented in the antenna tuning circuit 100. As shown in the figure, the switch 102 may be placed between the first interconnection node $N_1$ and the second interconnection node $N_2$. Hence, the switch 102 may be arranged to selectively couple the first interconnection node $N_1$ to the second interconnection node $N_2$. For example, the switch 102 may be implemented using a transistor. When the switch 102 is switched on, the first port 11 of the antenna structure 10 may be electrically connected to the second port 12 of the antenna structure 10; and when the switch 102 is switched off, the first port 11 of the antenna structure 10 may be isolated/disconnected from the second port 12 of the antenna structure 10. In this way, the switch 102 can significantly change the antenna topology based on its ON/OFF status.

The configurable circuit block 104 may be coupled between the RF source node $N_{RF}$ and the first interconnection node $N_1$. The configurable circuit block 106 may be coupled between the first interconnection node $N_1$ and a reference voltage (e.g., ground voltage GND). The configurable circuit block 108 may be coupled between the second interconnection node $N_2$ and a reference voltage (e.g., ground voltage GND). Each of the configurable circuit blocks 104, 106 and 108 may support a plurality of configurations with different circuit topologies and/or different electrical characteristics. Hence, the antenna structure 10 may support different antenna resonant modes controlled by the switch 102 and the configurable circuit blocks 104, 106, 108. In other words, with proper settings of the switch 102 and the configurable circuit blocks 104, 106, 108, a desired antenna resonant mode may be selected and enabled to meet the wireless communication requirement.

Figure 2:
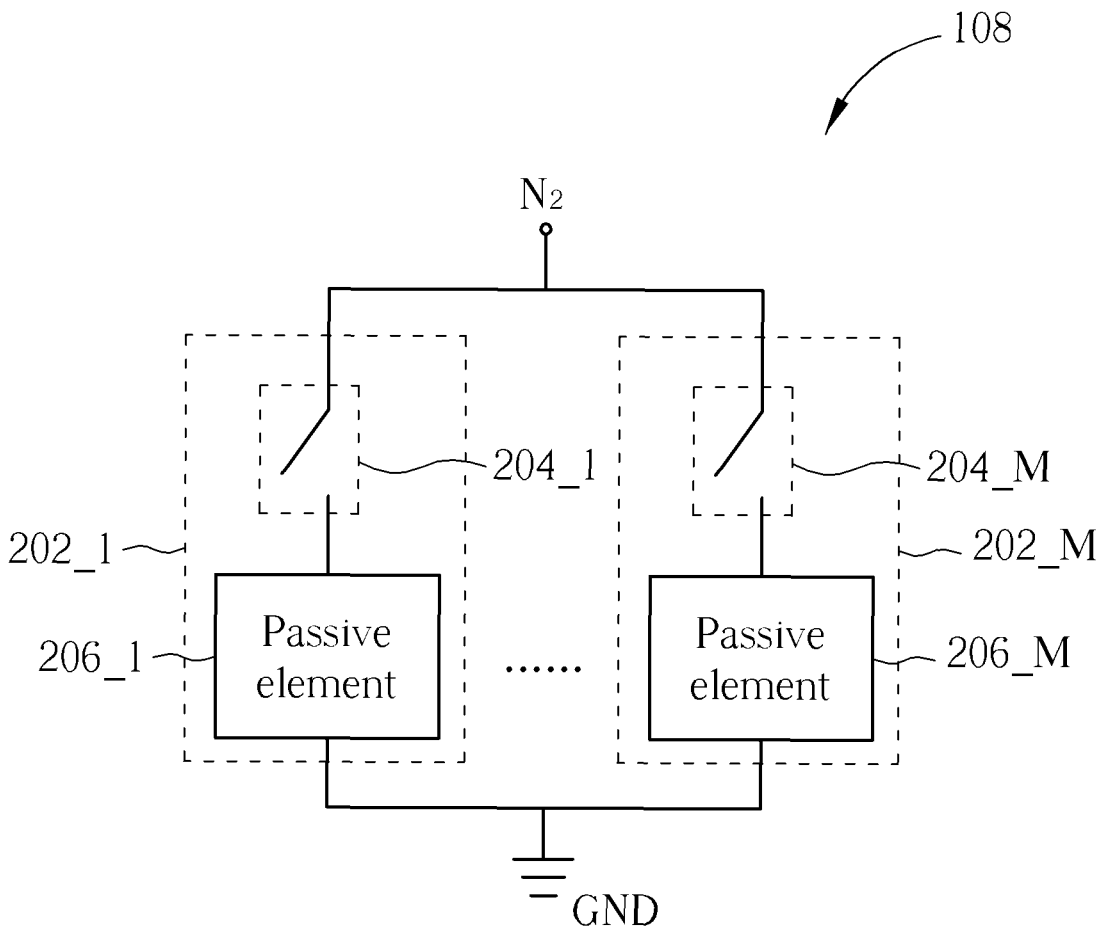
FIG. 2 is a diagram illustrating one exemplary embodiment of one configurable circuit block shown in FIG. 1.

FIG. 2 is a diagram illustrating one exemplary embodiment of the configurable circuit block 108 shown in FIG. 1. The configurable circuit block 108 may include one or more configurable units, each coupled between the second interconnection node $N_2$ and the ground voltage GND. As shown in the figure, the configurable circuit block 108 may have M configurable units 202_1-202_M, where M may be a positive integer equal to or greater than one. Therefore, when M=1, the configurable circuit block 108 has one configurable unit only; and when M>1, the configurable circuit block 108 has multiple configurable units connected in a parallel fashion. In this embodiment, each of the configurable units 202_1-202_M may have a switch (e.g., 204_1 or 204_M shown in FIG. 2) and a passive element (e.g., 206_1 or 206_M shown in FIG. 2) connected in series. The switches 204_1-204_M may be implemented using transistors. By way of example, but not limitation, the passive element 206_1 may be a capacitor with a pre-defined capacitance value or an inductor with a pre-defined inductance value; and the passive element 206_M may be a capacitor with a pre-defined capacitance value or an inductor with a pre-defined inductance value. In some embodiments, the capacitor(s) adopted in the passive element(s) may have variable capacitance. In some embodiments, the inductor(s) adopted in the passive element(s) may have variable inductance. As can be seen from FIG. 2, when each switch in the configurable circuit block 108 is switched off, the configurable circuit block 108 may be regarded as an open-ended circuit (e.g., a floating terminal). When the switch 202_1 is switched on and the remaining switches are switched off, the configurable circuit block 108 may be regarded as the passive element 206_1 coupled between the second interconnection node $N_2$ and the ground voltage GND. When the switch 202_M is switched on and the remaining switches are switched off, the configurable circuit block 108 may be regarded as the passive element 206_M coupled between the second interconnection node $N_2$ and the ground voltage GND. When the switches 202_1 and 202_M are both switched on and the remaining switches are switched off, the configurable circuit block 108 may be regarded as the passive elements 206_1 and 206_M coupled in a parallel fashion between the second interconnection node $N_2$ and the ground voltage GND. Hence, by controlling ON/OFF statuses of switches included in the configurable circuit block 108, the configurable circuit block 108 may be set to possess a specific circuit topology and a specific electrical characteristic.

Alternatively, based on the design requirement, any of the passive elements used in the configurable circuit block 108 may be selectively replaced with an open circuit or a short circuit. For example, when the passive element 206_1 is replaced with an open circuit, no circuit element/signal trace is connected between the switch 204_1 and the ground voltage; when the passive element 206_1 is replaced with a short circuit, a signal trace may be directly connected between the switch 204_1 and the ground voltage; when the passive element 206_M is replaced with an open circuit, no circuit element/signal trace is connected between the switch 204_M and the ground voltage; and when the passive element 206_M is replaced with a short circuit, a signal trace may be directly connected between the switch 204_M and the ground voltage. These alternative designs also fall within the scope of the present invention.

Figure 3:
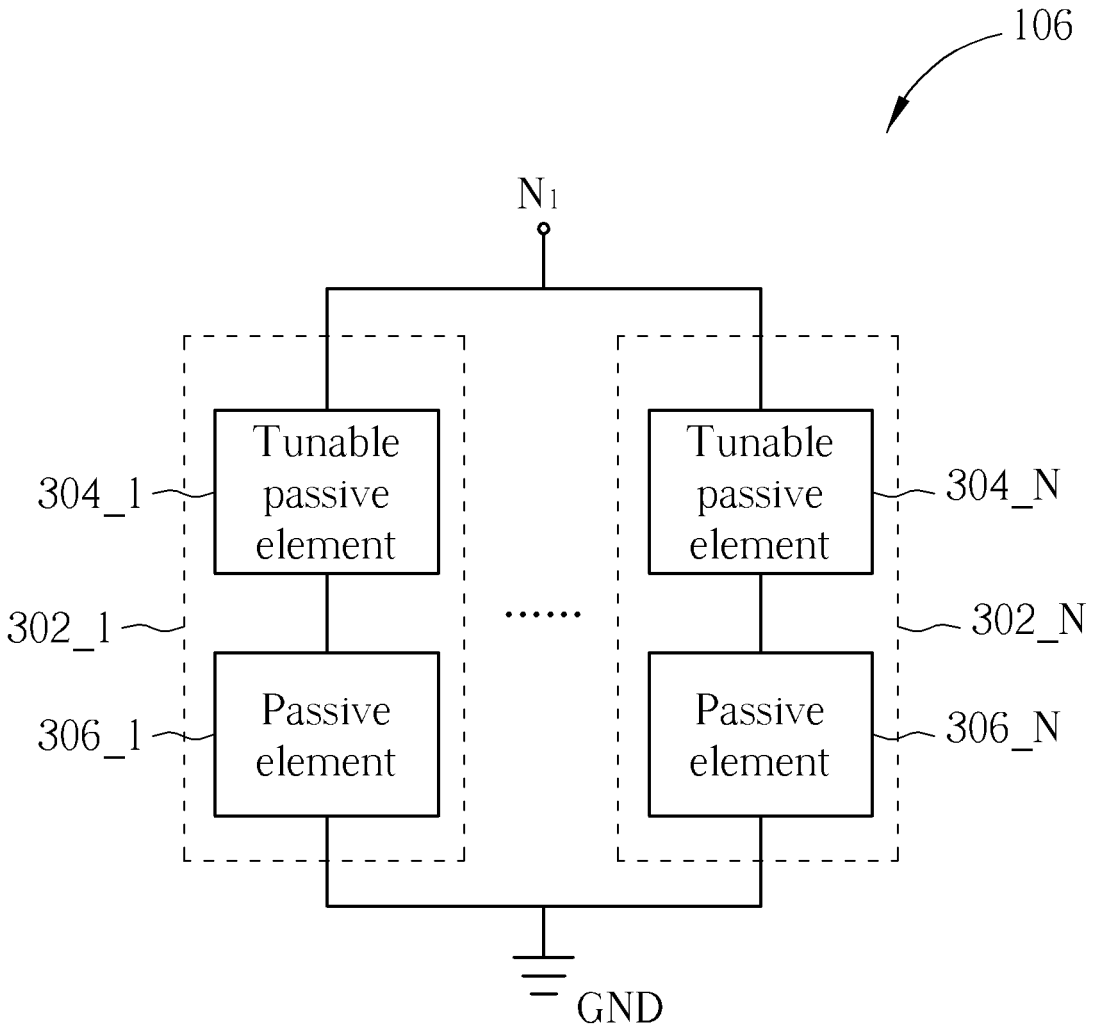
FIG. 3 is a diagram illustrating one exemplary embodiment of another configurable circuit block shown in FIG. 1.
Figure 4:
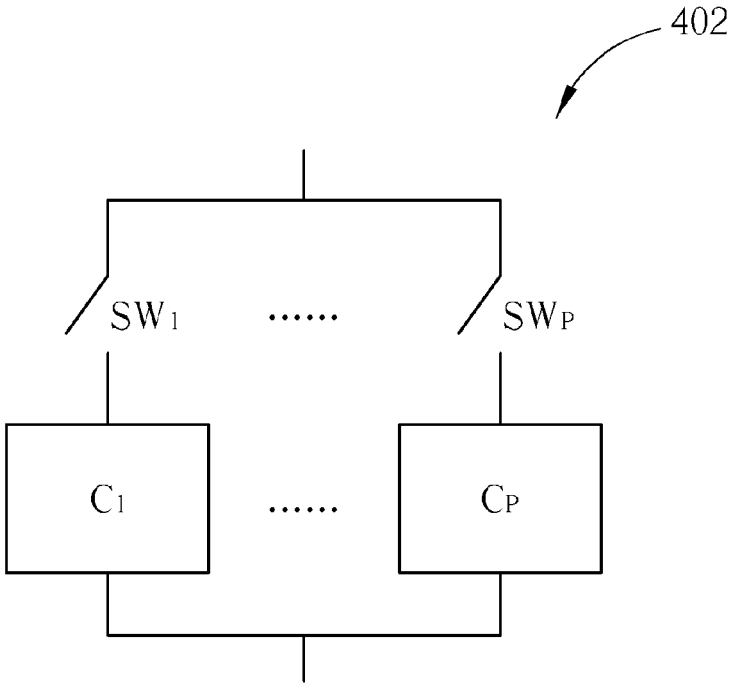
FIG. 4 is a diagram illustrating different implementations of the tunable capacitor used in the configurable circuit block shown in FIG. 3.
Figure 4:
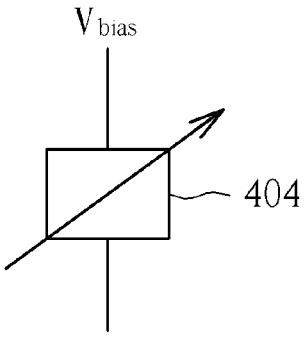

FIG. 3 is a diagram illustrating one exemplary embodiment of the configurable circuit block 106 shown in FIG. 1. The configurable circuit block 106 may include one or more configurable units, each coupled between the first interconnection node $N_1$ and the ground voltage GND. As shown in the figure, the configurable circuit block 106 may have N configurable units 302_1-302_N, where N may be a positive integer equal to or greater than one. Therefore, when N=1, the configurable circuit block 106 has one configurable unit only; and when N>1, the configurable circuit block 106 has multiple configurable units connected in a parallel fashion. In this embodiment, each of the configurable units 302_1-302_N may have a tunable passive element (e.g., 304_1 or 304_N shown in FIG. 3) and a passive element (e.g., 306_1 or 306_N shown in FIG. 3) connected in series. In some embodiments, the passive element(s) adopted in the configurable unit(s) may be omitted. By way of example, but not limitation, the tunable passive element 304_1 may be a tunable capacitor with an adjustable capacitance value, and the passive element 306_1 may be a capacitor with a pre-defined capacitance value or an inductor with a pre-defined inductance value. Similarly, the tunable passive element 304_N may be a tunable capacitor with an adjustable capacitance value, and the passive element 306_N may be a capacitor with a pre-defined capacitance value or an inductor with a pre-defined inductance value. In this embodiment, the tunable capacitor may be implemented using a capacitor array or a voltage-controlled capacitor. As shown in sub-diagram (A) of FIG. 4, the capacitor array 402 may have a plurality of capacitors $C_1$-$C_P$ and a plurality of switches $SW_1$-$SW_P$. Each of the capacitors $C_1$-$C_P$ may have a pre-defined capacitance value. Hence, the equivalent capacitance value possessed by the capacitor array 402 may be adjusted by controlling ON/OFF statuses of the switches $SW_1$-$SW_P$. More specifically, when more switches are switched on, the equivalent capacitance value is larger. As shown in sub-diagram (B) of FIG. 4, the capacitance value of the voltage-controlled capacitor 404 may be proportional to the voltage level of the bias voltage $V_{bias}$ applied thereto. Hence, the capacitance value of the voltage-controlled capacitor may be adjusted by controlling the bias voltage $V_{bias}$.

Alternatively, based on the design requirement, any of the passive elements used in the configurable circuit block 106 may be selectively replaced with an open circuit or a short circuit. For example, when the passive element 306_1 is replaced with an open circuit, no circuit element/signal trace is connected between the tunable passive element 304_1 and the ground voltage; when the passive element 306_1 is replaced with a short circuit, a signal trace may be directly connected between the tunable passive element 304_1 and the ground voltage; when the tunable passive element 304_N is replaced with an open circuit, no circuit element/signal trace is connected between the passive element 306_N and the first interconnection node $N_1$; and when the tunable passive element 304_N is replaced with a short circuit, a signal trace may be directly connected between the passive element 306_N and the first interconnection node $N_1$. These alternative designs also fall within the scope of the present invention.

As can be seen from FIG. 3, the equivalent electrical characteristic of the configurable circuit block 106 may change when at least one of the tunable passive elements in the configurable circuit block 106 is adjusted to have a new electrical characteristic value (e.g., a new capacitance value). Hence, by controlling one or more tunable passive elements in the configurable circuit block 106, the configurable circuit block 106 may be set to possess a specific electrical characteristic. In one exemplary design, the tunable passive elements and the passive elements in the configurable circuit block 106 may be implemented using capacitive elements for fine tuning antenna's high-frequency/high-band characteristics. However, this is not meant to be a limitation of the present invention.

Figure 5:
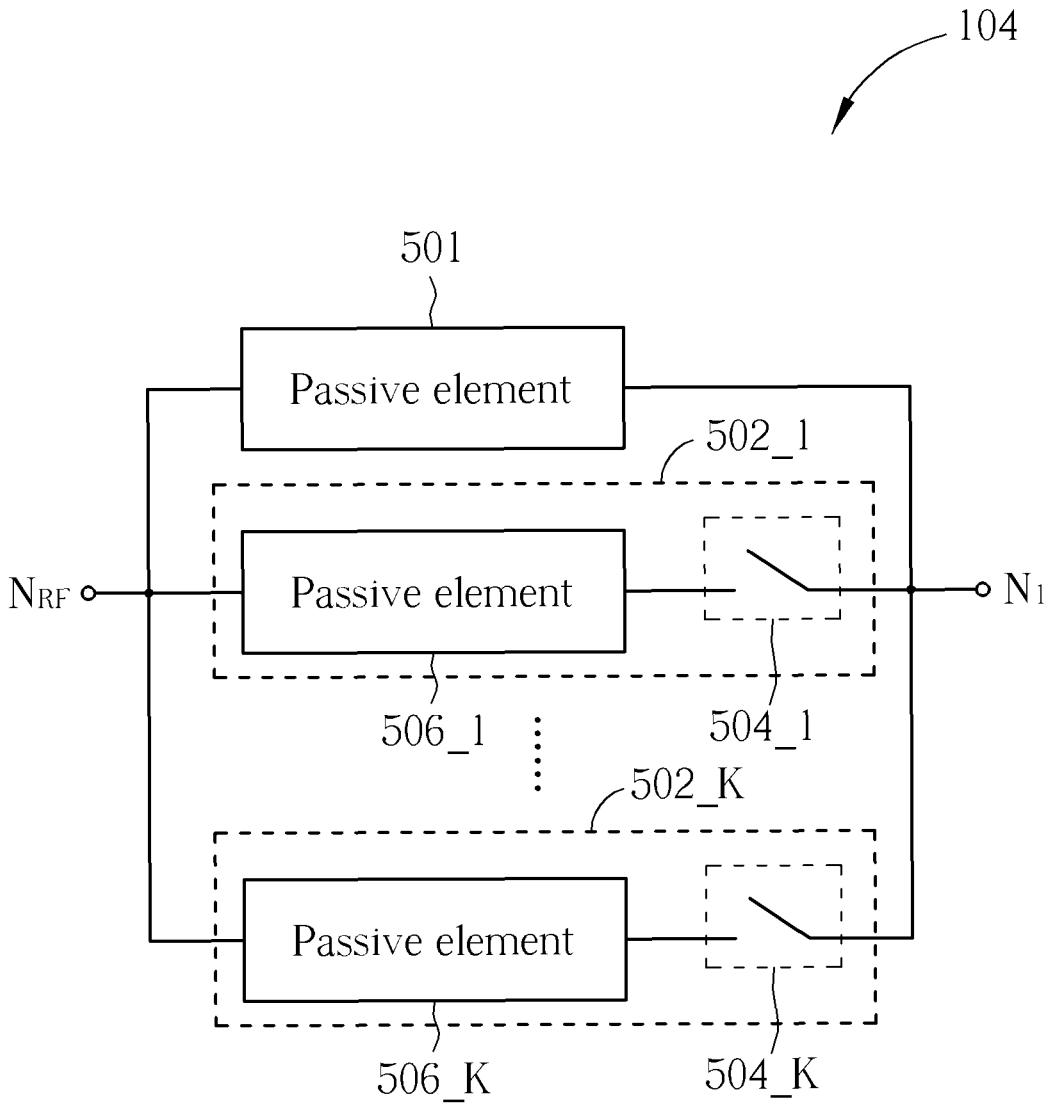
FIG. 5 is a diagram illustrating one exemplary embodiment of yet another configurable circuit block shown in FIG. 1.

FIG. 5 is a diagram illustrating one exemplary embodiment of the configurable circuit block 104 shown in FIG. 1. The configurable circuit block 104 may include one passive element 501 and at least one configurable unit, each coupled between the RF source node $N_{RF}$ and the first interconnection node $N_1$. As shown in the figure, the configurable circuit block 104 may have K configurable units 502_1-502_K, where K may be a positive integer equal to or greater than one. Therefore, when K=1, the configurable circuit block 104 has one configurable unit only; and when K>1, the configurable circuit block 104 has multiple configurable units connected in a parallel fashion. In this embodiment, each of the configurable units 502_1-502_K may have a switch (e.g., 504_1 or 504_K shown in FIG. 5) and a passive element (e.g., 506_1 or 506_K shown in FIG. 5) connected in series. The switches 504_1-504_K may be implemented using transistors. By way of example, but not limitation, the passive element 506_1 may be a capacitor with a pre-defined capacitance value or an inductor with a pre-defined inductance value; and the passive element 506_K may be a capacitor with a pre-defined capacitance value or an inductor with a pre-defined inductance value. In some embodiments, the capacitor(s) adopted in the passive element(s) may have variable capacitance. In some embodiments, the inductor(s) adopted in the passive element(s) may have variable inductance. In one exemplary design, the passive elements in the configurable circuit block 104 may be implemented using inductive elements for fine tuning antenna's low-frequency/low-band characteristics. However, this is not meant to be a limitation of the present invention.

Alternatively, based on the design requirement, any of the passive elements used in the configurable circuit block 104 may be selectively replaced with an open circuit or a short circuit. For example, when the passive element 501 is replaced with an open circuit, it is equivalent to omitting the passive element 501; when the passive element 501 is replaced with a short circuit, a signal trace may be directly connected between the RF source node $N_{RF}$ and the first interconnection node $N_1$; when the passive element 506_1 is replaced with an open circuit, no circuit element/signal trace is connected between the switch 504_1 and the RF source node $N_{RF}$; and when the passive element 506_1 is replaced with a short circuit, a signal trace may be directly connected between the switch 504_1 and the RF source node $N_{RF}$. These alternative designs also fall within the scope of the present invention.

As can be seen from FIG. 5, when each switch in the configurable circuit block 104 is switched off, the configurable circuit block 104 may be regarded as the passive element 501 coupled between the first interconnection node $N_1$ and the RF source node $N_{RF}$. When the switch 504_1 is switched on and the remaining switches are switched off, the configurable circuit block 104 may be regarded as the passive elements 501 and 506_1 connected in parallel between the first interconnection node $N_1$ and the RF source node $N_{RF}$. When the switch 504_K is switched on and the remaining switches are switched off, the configurable circuit block 104 may be regarded as the passive elements 501 and 506_K connected in parallel between the first interconnection node $N_1$ and the RF source node $N_{RF}$. When the switches 504_1 and 504_K are both switched on and the remaining switches are switched off, the configurable circuit block 104 may be regarded as the passive elements 501, 506_1 and 506_K connected in parallel between the first interconnection node $N_1$ and the RF source node $N_{RF}$. Hence, by controlling ON/OFF statuses of switches in the configurable circuit block 104, the configurable circuit block 104 may be set to possess a specific circuit topology and a specific electrical characteristic.

In accordance with the exemplary design of the antenna tuning circuit 100 shown in FIG. 1, the switch 102 and the configurable circuit block 108 may be arranged to coarsely tune an antenna resonant mode for the antenna structure 10, and the configurable circuit blocks 104 and 106 may be arranged to fine tune the antenna resonant mode for the antenna structure 10. More specifically, a preliminary antenna resonant mode may be set based on settings of the switch 102 and the configurable circuit block 108. For example, when the switch 102 is switched on, both of the first port 11 and the second port 12 may serve as feeding points. When the switch 102 is switched off, the first port 11 may serve as a feeding point, while the second port 12 may serve as a grounding point (if the second interconnection node $N_2$ is coupled to the ground voltage GND through the configurable circuit block 108) or a floating point (if the second interconnection node $N_2$ is open-circuited due to the configurable circuit block 108). Moreover, optimized further tuned antenna resonant mode may be obtained by properly setting the configurable circuit blocks 104 and 106. For example, the configurable circuit block 106 may be used to fine tune antenna's high-frequency/high-band characteristics, and the configurable circuit block 104 may be used to fine tune antenna's low-frequency/low-band characteristics.

It should be noted that the antenna tuning circuit design shown in FIG. 1 is for illustrative purposes only, and is not meant to be a limitation of the present invention. Alternatively, at least one of the configurable circuit blocks 104, 106 and 108 may be omitted or replaced by a non-configurable circuit block (e.g., a circuit block only composed of passive element(s) with pre-defined electrical characteristic value(s)). To put it another way, any antenna tuning circuit design having at least one switch designed to control a connection between two ports of a multi-port antenna structure for changing an antenna resonant mode of the multi-port antenna structure falls within the scope of the present invention. In addition, the configurable circuit block 104 may be used to fine tune the antenna resonant mode when implemented; the configurable circuit block 106 may be used to fine tune the antenna resonant mode when implemented; and the configurable circuit block 108 may be used to coarsely tune the antenna resonant mode when implemented.

For example, in a first alternative design where the configurable circuit block 104 shown in FIG. 1 is omitted or replaced by a non-configurable circuit block, the switch 102 and the configurable circuit block 108 may be arranged to coarsely tune the antenna resonant mode for the antenna structure 10, and the configurable circuit block 106 may be arranged to fine tune the antenna resonant mode for the antenna structure 10.

For another example, in a second alternative design where the configurable circuit block 106 shown in FIG. 1 is omitted or replaced by a non-configurable circuit block, the switch 102 and the configurable circuit block 108 may be arranged to coarsely tune the antenna resonant mode for the antenna structure 10, and the configurable circuit block 104 may be arranged to fine tune the antenna resonant mode for the antenna structure 10.

For yet another example, in a third alternative design where the configurable circuit block 108 shown in FIG. 1 is omitted or replaced by a non-configurable circuit block, the switch 102 may be arranged to coarsely tune the antenna resonant mode for the antenna structure 10, and the configurable circuit blocks 104 and 106 may be arranged to fine tune the antenna resonant mode for the antenna structure 10.

In above exemplary designs, one or both of switch 102 and configurable circuit block 108 may be used to coarsely tune the antenna resonant mode for the antenna structure 10, and one or both of configurable circuit blocks 104 and 106 may be used to fine tune the antenna resonant mode for the antenna structure 10. However, these are not meant to be limitations of the present invention. For example, with proper circuit designs of configurable circuit blocks 104, 106 and 108, one or both of configurable circuit blocks 104 and 106 may be used to coarsely tune the antenna resonant mode for the antenna structure 10, and one or both of switch 102 and configurable circuit block 108 may be used to fine tune the antenna resonant mode for the antenna structure 10. For another example, with proper circuit designs of configurable circuit blocks 104, 106 and 108, at least one of the configurable circuit blocks 104, 106 and 108 may be used to fine tune antenna's high-frequency/high-band characteristics, and at least another one of the configurable circuit blocks 104, 106 and 108 may be used to fine tune antenna's low-frequency/low-band characteristics. To put it simply, the present invention has no limitation on which circuit element(s) the antenna tuning circuit uses for antenna fine tuning and which circuit element(s) the antenna tuning circuit uses for antenna coarse tuning; and has no limitation on which circuit element(s) the antenna tuning circuit uses for antenna's high-frequency/high-band characteristic tuning and which circuit element(s) the antenna tuning circuit uses for antenna's low-frequency/low-band characteristic tuning. That is, any antenna tuning assignment/combination of the switch 102 and the configurable circuit blocks 104, 106 and 108 is feasible. Hence, no matter which antenna tuning assignment/combination is employed, any antenna tuning circuit having the proposed circuit architecture shown in FIG. 1 falls within the scope of the present invention.

Figure 6:
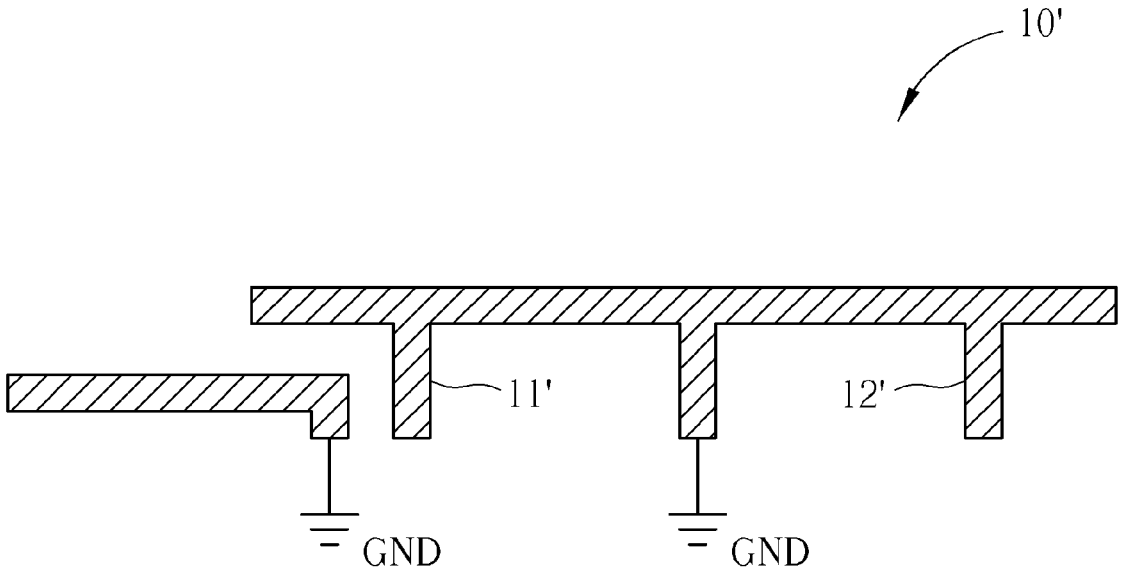
FIG. 6 is a diagram illustrating an alternative antenna structure according to an embodiment of the present invention.

It should be noted that the antenna structure 10 shown in FIG. 1 is for illustrative purposes only, and is not meant to be a limitation of the present invention. Specifically, the present invention has no limitation on the multi-port antenna structure design to which the proposed antenna tuning circuit is applied. For example, additional parasitic strip(s) and/or additional shorting path(s) may be added to the antenna structure 10 shown in FIG. 1. FIG. 6 is a diagram illustrating an alternative antenna structure according to an embodiment of the present invention. For example, the antenna structure 10' may be obtained by modifying the antenna structure 10. The antenna structure 10' is different from the antenna structure 10, and may be designed to meet a specific wireless communication requirement. As can be seen from FIG. 6, the antenna structure 10' may also be a multi-port antenna structure having at least a first port 11' and a second port 12', where the first port 11' may be coupled to the first interconnection node $N_1$ of the antenna tuning circuit 100, and the second port 12' may be coupled to the second interconnection port $N_2$ of the antenna tuning circuit 100.

As mentioned above, the antenna tuning circuit 100 is capable of setting the antenna resonant mode. Specifically, since the antenna tuning circuit 100 is configurable, the antenna tuning circuit 100 is capable of enabling one of a plurality of candidate antenna resonant modes. The enabled antenna resonant mode is required to satisfy the frequency requirement. In this embodiment, a modulator-demodulator (modem) may be used to control the switch 102 and the configurable circuit blocks 104, 106, and 108 due to the fact that the modem has frequency information associated with the wireless communications.

Figure 7:
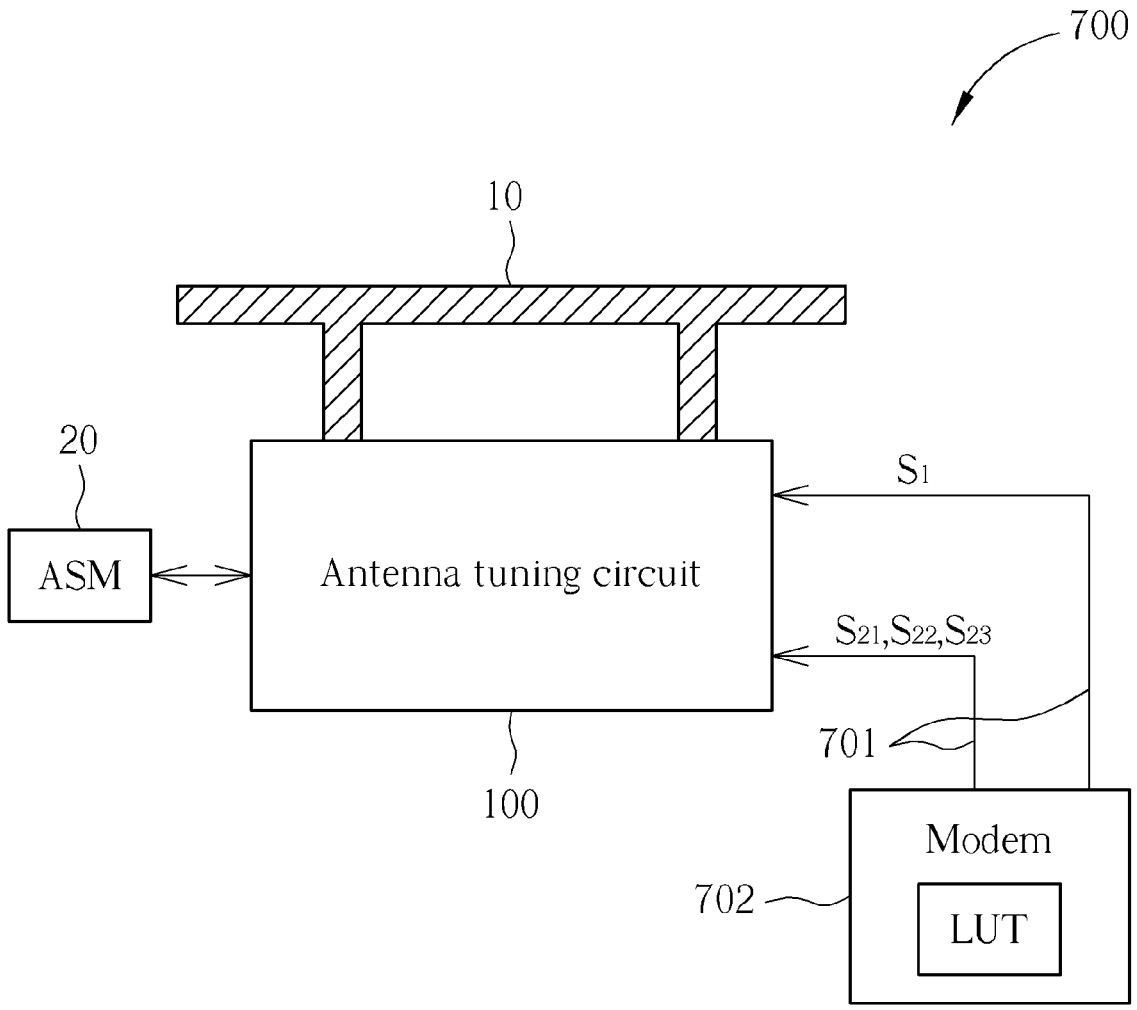
FIG. 7 is a diagram illustrating an electronic device using the proposed adaptive antenna solution according to an embodiment of the present invention.

Please refer to FIG. 7, which is a diagram illustrating an electronic device using the proposed adaptive antenna solution according to an embodiment of the present invention. The electronic device 700 may be a portion or the entirety of any mobile device equipped with wireless communication capability, and may include ASM 20, antenna structure 10 and antenna tuning circuit 100 shown in FIG. 1. In addition, the electronic device 700 may have a modem 702 used to generate control signals to the antenna tuning circuit 100 through open-loop tuning. For example, based on the frequency information associated with the wireless communications, the modem 702 may refer to a look-up table (LUT) to find settings of control signals needed to drive the antenna tuning circuit 100 to set a desired antenna resonant mode for the antenna structure 10, and may transmit the control signals to the antenna tuning circuit 100 via control lines 701. For example, the control lines 701 may be a portion or the entirety of a Mobile Industry Processor Interface (MIPI), a General Purpose Input/Output (GPIO) bus, or a Serial Peripheral Interface (SPI). In this embodiment, a first control signal $S_1$ may be generated from the modem 702 to the switch 102. That is, the first control signal $S_1$ may act as a switch control signal. Hence, the switch 102 may selectively couple the first interconnection node $N_1$ to the second interconnection node $N_2$ in response to the first control signal $S_1$. In addition, the modem 702 may further generate a plurality of second control signals $S_{21}$, $S_{22}$, and $S_{23}$ to the configurable circuit blocks 104, 106, and 108, respectively. For example, each of the second control signals $S_{21}$, $S_{22}$, and $S_{23}$ may include control information needed to set switch(es) and/or tunable passive element(s) implemented in a configurable circuit block. Specifically, a configuration of the configurable circuit block 104 may be set based on the second control signal $S_{21}$, a configuration of the configurable circuit block 106 may be set based on the second control signal $S_{22}$, and a configuration of the configurable circuit block 108 may be set based on the second control signal $S_{23}$.

As mentioned above, at least one of the configurable circuit blocks 104, 106, and 108 may be omitted or replaced by a non-configurable circuit block in an alternative design. Hence, in the alternative design, the modem 702 may be modified to omit at least one of the second control signals $S_{21}$, $S_{22}$, and $S_{23}$ correspondingly.

Figure 8:
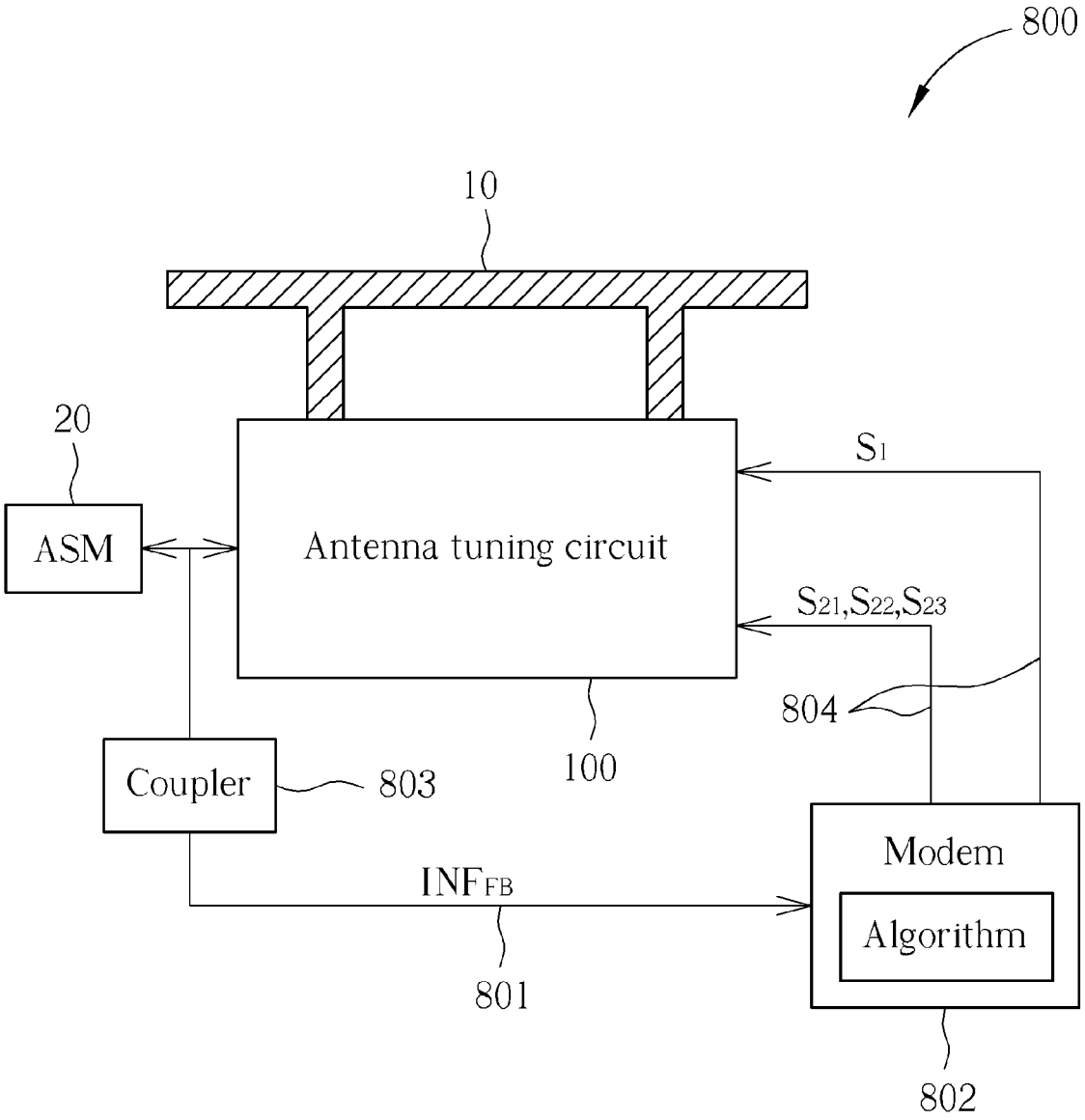
FIG. 8 is a diagram illustrating an electronic device using the proposed adaptive antenna solution according to another embodiment of the present invention.

Please refer to FIG. 8, which is a diagram illustrating an electronic device using the proposed adaptive antenna solution according to another embodiment of the present invention. The electronic device 800 may be a portion or the entirety of any mobile device equipped with wireless communication capability, and may include ASM 20, antenna structure 10 and antenna tuning circuit 100 shown in FIG. 1. In addition, the electronic device 800 may have a modem 802 used to generate control signals to the antenna tuning circuit 100 through closed-loop tuning. As shown in FIG. 8, a coupler 803 may be located at a feedback path 801, and may provide feedback information $INF_{FB}$ derived from an RF signal transmitted between the ASM 20 and the antenna tuning circuit 100. Based on the frequency information associated with the wireless communications and the feedback information $INF_{FB}$ provided from the coupler 803, the modem 802 may use an algorithm to obtain settings of control signals needed to drive the antenna tuning circuit 100 to set a desired antenna resonant mode for the antenna structure 10, and may transmit the control signals to the antenna tuning circuit 100 via control lines 804. For example, the control lines 804 may be a portion or the entirety of a Mobile Industry Processor Interface (MIPI), a General Purpose Input/Output (GPIO) bus, or a Serial Peripheral Interface (SPI). In this embodiment, the closed-loop tuning may keep updating at least one of first control signal $S_1$ and second control signals $S_{21}$, $S_{22}$, $S_{23}$ until a signal quality indicator estimated by the modem 802 shows that the antenna resonant mode has been properly tuned to ensure an acceptable RF signal quality.

The circuit configurations in FIGS. 1, 2, 3 and 5 are shown as implemented using discrete circuit components. However, this is not meant to be a limitation of the present invention. Alternatively, one or more integrated modules may be used to realize the antenna tuning circuit on a printed circuit board (PCB).

Figure 9:
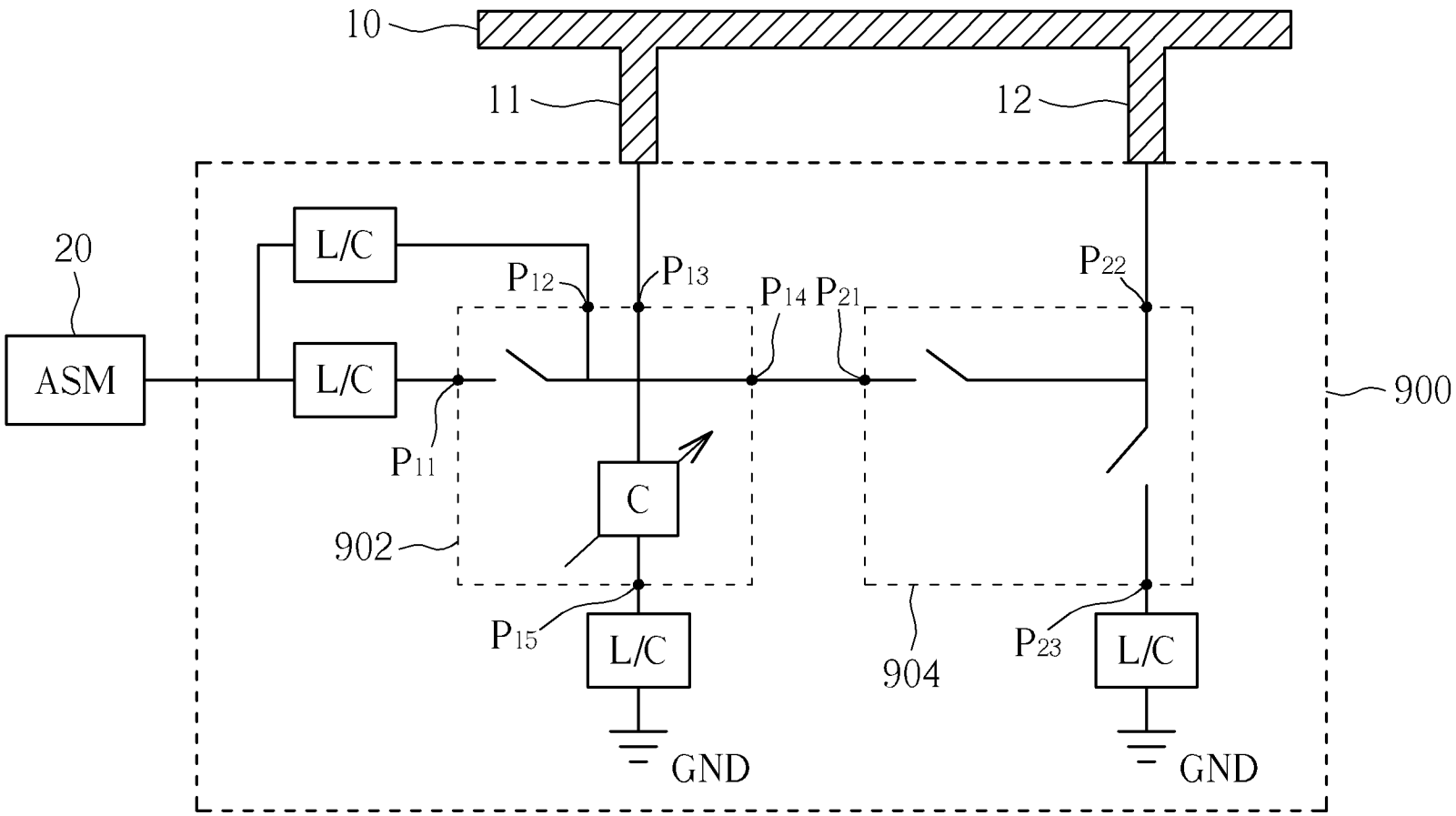
FIG. 9 is a diagram illustrating an antenna tuning circuit with multiple integrated modules according to an embodiment of the present invention.

FIG. 9 is a diagram illustrating an antenna tuning circuit with multiple integrated modules according to an embodiment of the present invention. The antenna tuning circuit 900 may follow the same architecture shown in FIG. 1. In this embodiment, the antenna tuning circuit 900 may have the configurable circuit block 104 implemented using the architecture shown in FIG. 5 with K=1, the configurable circuit block 106 implemented using the architecture shown in FIG. 3 with N=1, and the configurable circuit block 108 implemented using the architecture shown in FIG. 2 with M=1, where each passive element may be either an inductor or a capacitor, and the tunable passive element may be a tunable capacitor. As shown in FIG. 9, the antenna tuning circuit 900 may have two integrated modules (e.g., chips) 902 and 904. Concerning the integrated module 902, it may have a plurality of connection ports $P_{11}$, $P_{12}$, $P_{13}$, $P_{14}$, and $P_{15}$, and may contain one switch (which may be part of the configurable circuit block 104) and one tunable capacitor (which may be part of the configurable circuit block 106) integrated therein. Concerning the integrated module 904, it may have a plurality of connection ports $P_{21}$, $P_{22}$, and $P_{23}$, and may contain one switch (i.e., switch 102) and another switch (which may be part of the configurable circuit block 108) integrated therein.

Figure 10:
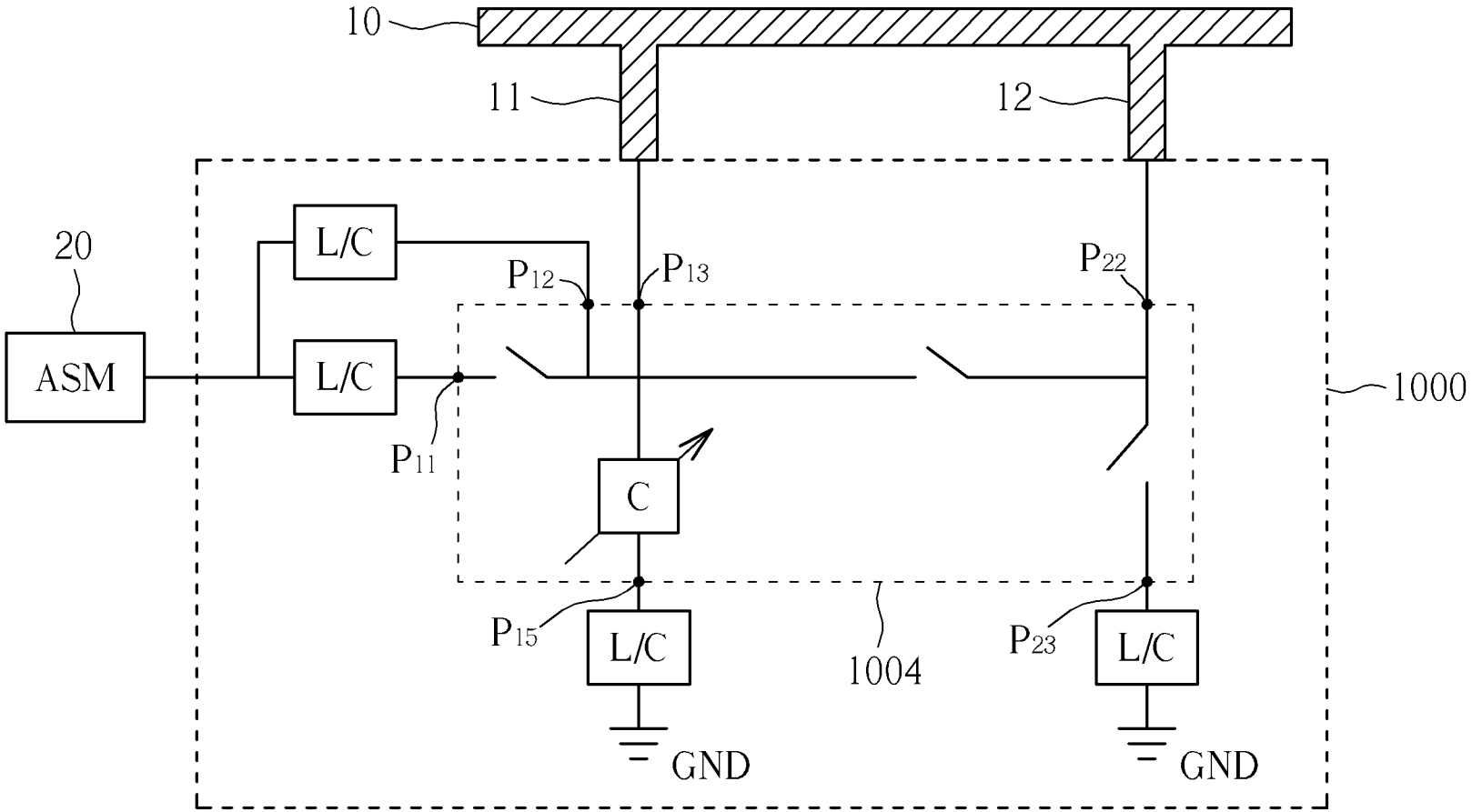
FIG. 10 is a diagram illustrating an antenna tuning circuit with one integrated module according to an embodiment of the present invention.

FIG. 10 is a diagram illustrating an antenna tuning circuit with one integrated module according to an embodiment of the present invention. The major difference between the antenna tuning circuits 900 and 1000 is that the integrated modules 902 and 904 are replaced with one integrated module (e.g., one chip) 1004. Hence, the integrated module 1004 may have connection ports $P_{11}$, $P_{12}$, $P_{13}$, $P_{15}$, $P_{22}$, and $P_{23}$.

Figure 11:
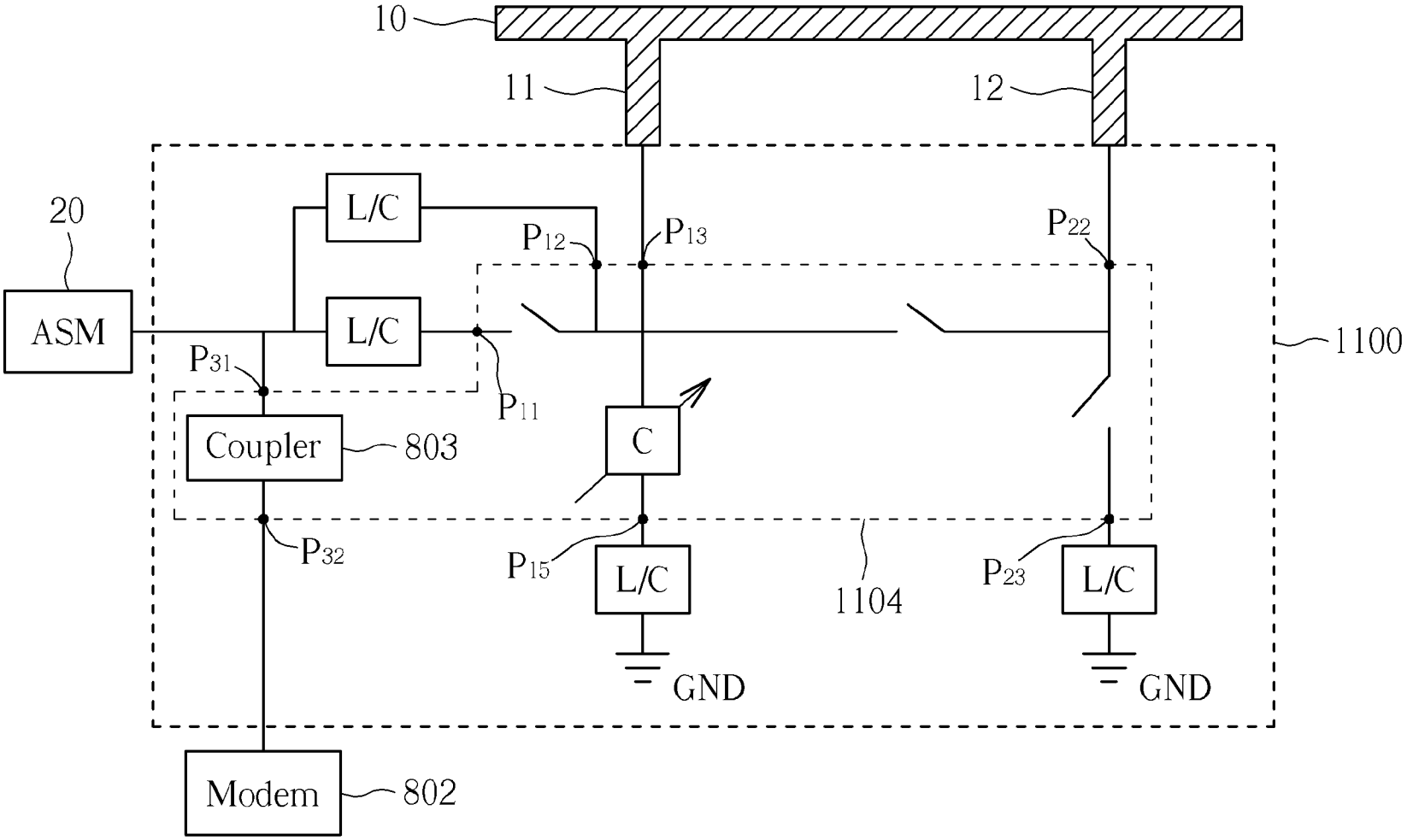
FIG. 11 is a diagram illustrating another antenna tuning circuit with one integrated module according to an embodiment of the present invention.

FIG. 11 is a diagram illustrating another antenna tuning circuit with one integrated module according to an embodiment of the present invention. The major difference between the antenna tuning circuits 1000 and 1100 is that the integrated module 1104 further has the aforementioned coupler 803 integrated therein. Hence, the integrated module 1104 may have connection ports $P_{11}$, $P_{12}$, $P_{13}$, $P_{15}$, $P_{22}$, $P_{23}$, $P_{31}$, and $P_{32}$.

Please note that although the RF source node is coupled to ASM in the above embodiments, the embodiments in which the RF source node coupled to any other components are still within scope of the invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna tuning circuit for setting an antenna resonant mode of an antenna structure, comprising:

a switch, arranged to selectively couple a first interconnection node to a second interconnection node, wherein the first interconnection node is coupled to a first port of the antenna structure, and the second interconnection node is coupled to a second port of the antenna structure; and at least one configurable circuit block, coupled to at least one of the first interconnection node and the second interconnection node, wherein the at least one configurable circuit block comprises a first configurable circuit block, coupled between the first interconnection node and a radio frequency (RF) source node.

2. The antenna tuning circuit of claim 1, wherein the at least one configurable circuit block further comprises:

a second configurable circuit block, coupled between one of the first interconnection node and the second interconnection node and a reference voltage.

3. The antenna tuning circuit of claim 2, wherein the second configurable circuit block comprises:

at least one configurable unit, each coupled between the second interconnection node and the reference voltage and comprising at least a switch.

4. The antenna tuning circuit of claim 2, wherein the second configurable circuit block comprises:

at least one configurable unit, each coupled between the first interconnection node and the reference voltage and comprising a tunable passive element.

5. The antenna tuning circuit of claim 4, wherein the tunable passive element is a tunable capacitor.

6. The antenna tuning circuit of claim 1, wherein the first configurable circuit block comprises:

a first passive element, coupled between the first interconnection node and the RF source node; and at least one configurable unit, each coupled between the first interconnection node and the RF source node and comprising a second passive element and a switch coupled in series.

7. The antenna tuning circuit of claim 6, wherein the first passive element and the second passive element are inductors.

8. The antenna tuning circuit of claim 1, wherein the at least one configurable circuit block further comprises:

a second configurable circuit block, coupled between the first interconnection node and a reference voltage; and a third configurable circuit block, coupled between the second interconnection node and the reference voltage.

9. The antenna tuning circuit of claim 8, wherein the switch and the third configurable circuit block are arranged to coarsely tune the antenna resonant mode; and the first configurable circuit block and the second configurable circuit block are arranged to fine tune the antenna resonant mode.

10. The antenna tuning circuit of claim 1, wherein the at least one configurable circuit block further comprises:

a second configurable circuit block, coupled between the second interconnect node and a reference voltage.

11. The antenna tuning circuit of claim 10, wherein the switch and the second configurable circuit block are arranged to coarsely tune the antenna resonant mode; and the first configurable circuit block is arranged to fine tune the antenna resonant mode.

12. The antenna tuning circuit of claim 1, wherein the at least one configurable circuit block further comprises:

a second configurable circuit block, coupled between the first interconnect node and a reference voltage.

13. The antenna tuning circuit of claim 12, wherein the switch is arranged to coarsely tune the antenna resonant mode; and the first configurable circuit block and the second configurable circuit block are arranged to fine tune the antenna resonant mode.

14. An antenna tuning method for setting an antenna resonant mode of an antenna structure, comprising:

generating a first control signal;

selectively coupling a first interconnection node to a second interconnection node in response to the first control signal, wherein the first interconnection node is coupled to a first port of the antenna structure, and the second interconnection node is coupled to a second port of the antenna structure; generating at least one second control signal; and based on the at least one second control signal, setting a configuration of at least one configurable circuit block coupled to at least one of the first interconnection node and the second interconnection node, wherein the at least one configurable circuit block comprises a first configurable circuit block, coupled between the first interconnection node and a radio frequency (RF) source node.

15. The antenna tuning method of claim 14, wherein at least one of the first control signal and the at least one second control signal is generated by a modulator-demodulator (modem) through open-loop tuning.

16. The antenna tuning method of claim 14, wherein at least one of the first control signal and the at least one second control signal is generated by a modulator-demodulator (modem) through closed-loop tuning.

17. An antenna tuning circuit for setting an antenna resonant mode of an antenna structure, comprising:

a switch, arranged to selectively couple a first interconnection node to a second interconnection node, wherein the first interconnection node is coupled to a first port of the antenna structure, and the second interconnection node is coupled to a second port of the antenna structure; and at least one configurable circuit block, coupled to at least one of the first interconnection node and the second interconnection node, wherein the at least one configurable circuit block comprises:

a first configurable circuit block, coupled between the first interconnection node and a reference voltage; and a second configurable circuit block, coupled between the second interconnection node and the reference voltage.

18. The antenna tuning circuit of claim 17, wherein the switch and the second configurable circuit block are arranged to coarsely tune the antenna resonant mode; and the first configurable circuit block is arranged to fine tune the antenna resonant mode.

* * * * *